United States Patent [19]

Miller et al.

[11] Patent Number: 4,965,951

[45] Date of Patent: Oct. 30, 1990

[54] LARGE CAPACITY AMMUNITION MAGAZINE

[76] Inventors: Michael K. Miller; Warren D. Stockton, both of 405 E. 19th St., Bakersfield, Calif. 93305

[21] Appl. No.: 396,211

[22] Filed: Aug. 11, 1989

Related U.S. Application Data

[62] Division of Ser. No. 260,052, Oct. 20, 1988, Pat. No. 4,888,898.

[51] Int. Cl.[5] ..... F41C 25/10; F41D 10/12; F41D 10/24

[52] U.S. Cl. ..... 42/49.01; 89/33.02

[58] Field of Search ..... 42/49.01, 19; 89/33.02, 89/33.1, 34

[56] References Cited

U.S. PATENT DOCUMENTS

| | | | |
|---|---|---|---|
| 213,555 | 3/1879 | Evans | 42/49.01 |
| 3,088,378 | 5/1963 | Boudreau | 42/49.01 |
| 4,034,644 | 7/1977 | Hupp et al. | 42/49.01 |
| 4,384,508 | 5/1983 | Sullivan et al. | 89/33.02 |
| 4,487,103 | 12/1984 | Atchisson | 89/33.02 |
| 4,676,137 | 6/1987 | Stockton et al. | 89/33.02 |
| 4,738,183 | 4/1988 | Miller et al. | 89/34 |
| 4,745,842 | 5/1988 | Shou-Fu | 89/33.02 |
| 4,766,800 | 8/1988 | Miller et al. | 89/33.02 |

*Primary Examiner*—David H. Brown

*Attorney, Agent, or Firm*—Roylance, Abrams, Berdo & Goodman

[57] ABSTRACT

An improved magazine wherein cartridges are loaded therein in two nested helical rows. Improvements further include a spring loaded feed lip bar which permits rapid loading and unloading of the magazine; a rod inside the drive spring in the magazine which prevents kinking and other undesirable operation characteristics of the main drive spring and which also permits the main drive spring tension to be released only when the magazine is not mounted on the cooperating gun; and a folding winder which is part of the magazine's rear end clutch and winder assembly which speeds winding of the spring.

3 Claims, 4 Drawing Sheets

FIG. 1
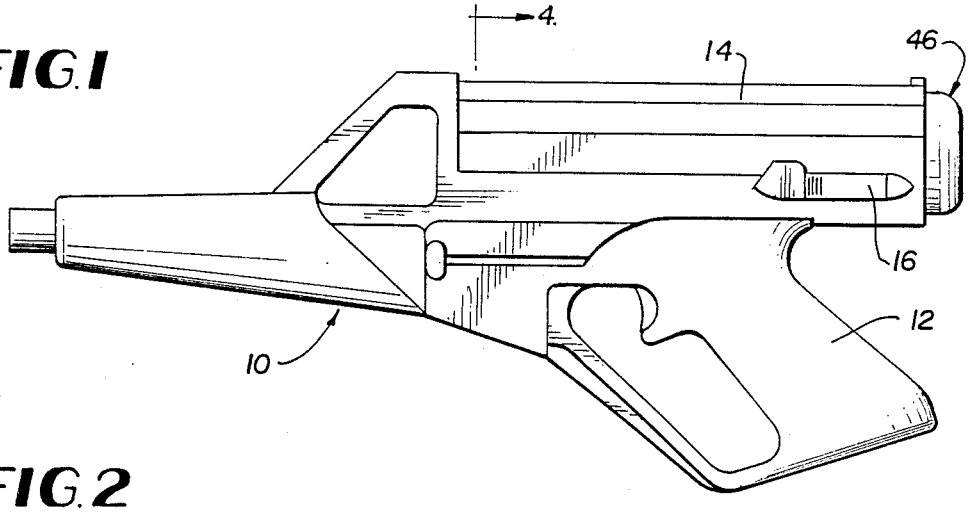
FIG. 2
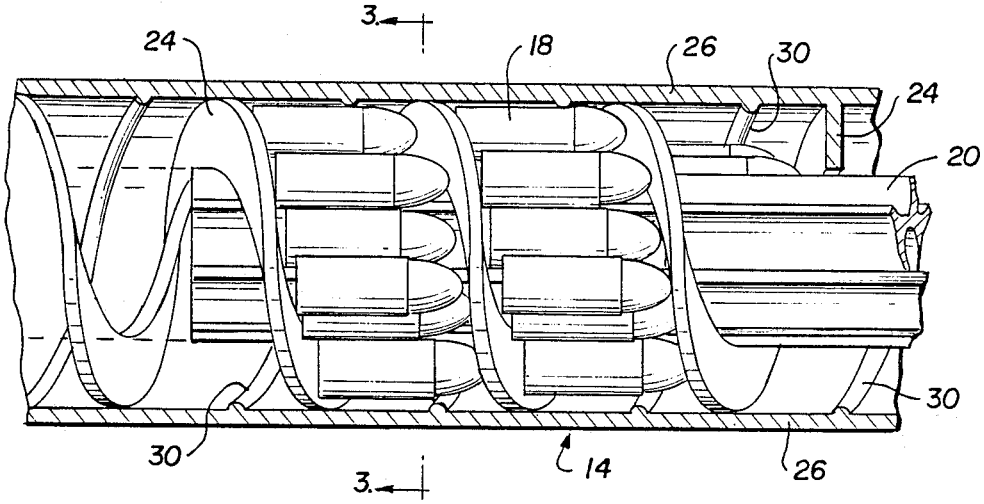
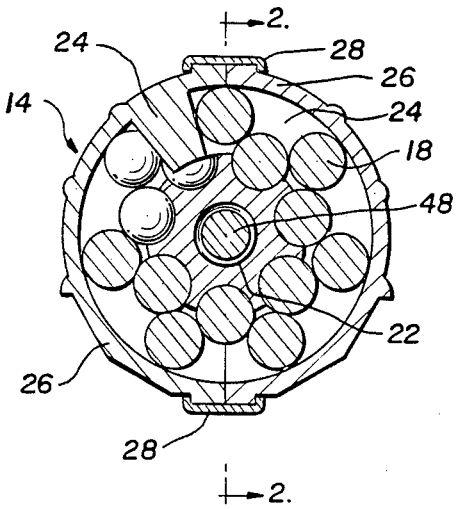
FIG. 3
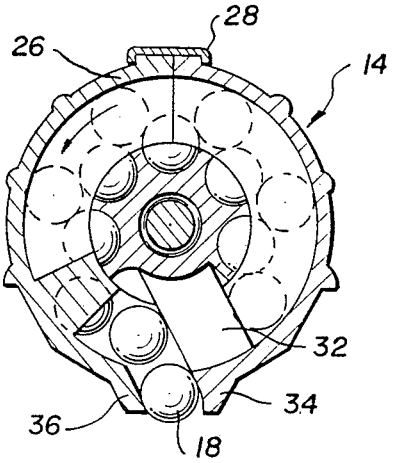
FIG. 4

FIG. 5
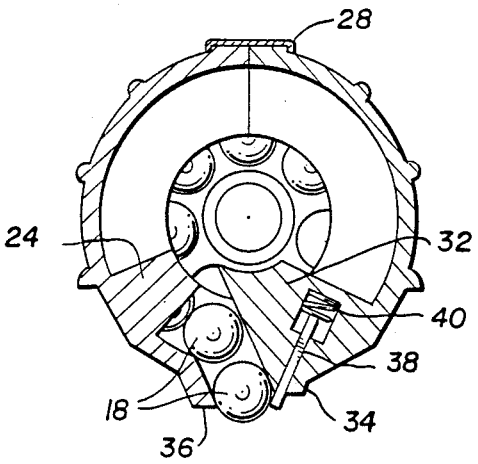
FIG. 7
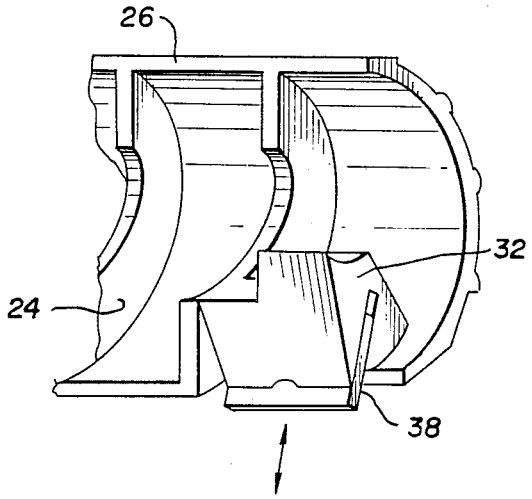
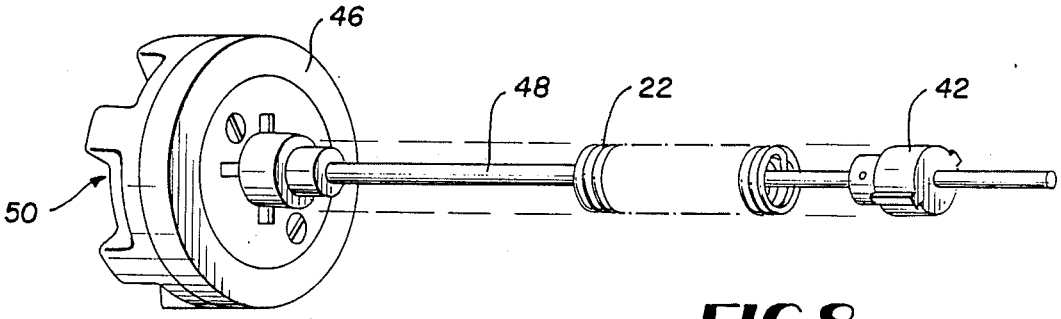
FIG. 8
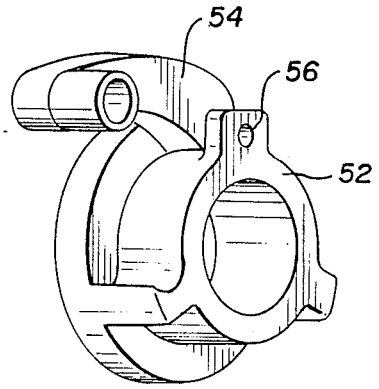
FIG. 9

LARGE CAPACITY AMMUNITION MAGAZINE

This is a division of application Ser. No. 260,052, filed Oct. 20, 1988, now U.S. Pat. No. 4,888,898.

CROSS REFERENCE TO RELATED PATENTS

This application is related to U.S. Pat. Nos. 4,676,137; 4,766,800 and 4,738,183; all in the names of applicants above, the entire disclosures of which are hereby incorporated by reference as if here set forth in full.

FIELD OF THE INVENTION

This invention relates to firearms and more particularly to a large capacity magazine for automatic and semi-automatic firing guns.

BACKGROUND OF THE INVENTION

The history of the development of firearms, especially as instruments of warfare and defense, has been guided by the goal of propelling the largest number of projectiles toward their target(s) as accurately and quickly as possible. The number of cartridges that can be fired before stopping to reload is a critical factor in firearm efficiency, and firearm technology has thus progressed from the muzzle-loaded single-shot flintlock rifle to the "six-shooter" revolver, and on to the magazine-fed automatic and semi-automatic assault rifles of today. The capacity of contemporary magazines for firearms is limited by factors of size, weight, handling, and overall dimensions. A conventional stack-type magazine extends perpendicular to the barrel of the firearm, and if such a magazine were made with a very large capacity the resulting magazine/firearm system would be prohibitively cumbersome.

This invention is a significant advancement in firearm magazine technology in that it produces a firearm system with a very large capacity (three to four times as many cartridges as a conventional magazine) and yet is compact, unobtrusive, and actually enhances the handling characteristics and accuracy of the firearm. This invention is also a significant improvement on the related patents identified above.

BRIEF DESCRIPTION OF THE INVENTION

The invention is a firearm magazine which is outwardly cylindrical and has means to be removeably attached to a suitable cooperating firearm, with its longitudinal axis parallel to and above the barrel of the firearm. More specifically, the magazine is comprised of two main components; a basically cylindrical outer shell with a helical rib extending around and along the full length of its inner surface, and a basically cylindrical fluted cartridge carrier which aligns the cartridges in longitudinal grooves around its outer surface and is rotationally driven inside the outer shell by a co-axial torque spring. An element of this invention which is a significant improvement on our aforementioned patents is that it affords a double layer of cartridges stored in two nested helical layers inside the magazine rather than the single layer described in our previous patents.

SUMMARY AND ADVANTAGES OF THE INVENTION

In the present invention, the cartridge carrier contacts and rotationally drives the inner layer of cartridges, which in turn contacts and rotationally drives the outer layer of cartridges. The cartridges of both layers are longitudinally advanced by the helical rib as they are rotated by the cartridge carrier, so they are consecutively presented at the magazine opening. When a cartridge approaches the magazine opening it is forced against a fixed ramp which lifts it out of its groove in the cartridge carrier. The cartridge is forced by succeeding cartridges against restraining "feed lips" which project from either side of the magazine opening and allow only the one cartridge to be removed from the magazine out along a path parallel to the magazine's longitudinal axis.

Feed lips are common to most firearm magazines. However, the present invention further advances magazine technology by spring-loading one of the pair of feed lips, so that in its extended position the feed lip effectively restrains the cartridges, while in its retracted position the cartridges can freely enter or exit the magazine in a radial direction. The spring-loaded feed lip is especially useful in allowing the magazine to be loaded quickly—the cartridges need only be successively pushed directly against the feed lip, in one direction, to enter the magazine. In conventional stack magazines with a single cartridge-width opening, the cartridges must first be forced down into the magazine, and then pushed back under the fixed feed lip in order to load the cartridges into the magazine. The spring-loaded feed lip of the invention is especially suited to its helical-feed magazine because it allows a very large number of cartridges to be loaded or unloaded quickly.

This invention incorporates another feature which is a significant improvement on our previous patents, namely a rod which is co-axial with the magazine drive spring and extends the full length of the magazine. The function of this rod is to alleviate two undesirable characteristics of our prior design, namely "kinking" of the magazine drive spring when overwound, and the accidental disengaging of the magazine drive spring clutch after the magazine has been installed on the firearm. In the preferred embodiment, the rod extends inside the full length of the magazine drive spring, absolutely preventing the spring from "kinking" over on itself as it would naturally tend to do in an extremely overwound condition. Further, the rod is of a diameter calculated to prevent overwinding, i.e., as the helical torque spring is progressively wound its diameter proportionately decreases, until, at the desired number of turns, the inside diameter of the spring closes down on the rod and effectively stops further winding of the spring. Additionally, the fore end of the rod protrudes through the magazine's front end cap and the aft end of the rod is attached to the moveable part of the magazine clutch in such a manner that, when the magazine is properly installed on the firearm, the fore end of the rod impinges on a solid surface of the firearm and prevents an accidental or even a purposeful disengagement of the magazine clutch. Thus, this feature assures that the spring can be unwound only when the magazine is not mounted on the gun.

The current invention further improves upon the prior art in that it incorporates a "fold-away" handle to aid in winding the magazine spring. Our prior patented magazine included a fluted knob with a diameter smaller than that of the magazine which the user had to repetitively grasp, twist, and release in order to wind up the magazine spring. The current invention includes a curved folding winding handle, the curve matching the outside diameter of the magazine, which is pivotally attached in a notch in the outer diameter of the clutch winding knob. In the retracted position the handle has no radial protrusion beyond the diameter of the magazine, and when extended outwardly the handle increases the user's leverage advantage in overcoming the torque of the spring. Additionally, the user need not release the handle until the spring is fully wound, i.e., the user can wind up the spring quickly in one continuous motion.

The four above described features, namely, the "double row helix" arrangement of cartridges, the spring-loaded feed lip, the co-axial rod, and the fold-out winding handle, singly and collectively comprise significant improvements on the prior art of firearm magazines including our own prior patents described above.

BRIEF DESCRIPTION OF THE FIGURES OF THE DRAWING

This invention will be more clearly understood when read together with the accompanying drawings also forming part of this disclosure, wherein:

FIG. 1 is a side elevational view of a weapon having the magazine of the invention mounted thereon;

FIG. 2 is a cross-sectional view of the invention magazine taken approximately on line 2—2 of FIG. 3 with some parts broken away and omitted;

FIG. 3 is a cross-sectional view taken on line 3—3 of FIG. 2;

FIG. 4 is a cross-sectional view similar to FIG. 3 but taken approximately at the position on the magazine indicated by the arrow 4 on FIG. 1;

FIG. 5 is a cross-sectional view very similar to FIG. 4 but taken at a slightly different transverse cutting plane in order to better illustrate the spring-loaded feed lip feature of the invention;

FIG. 7 is an enlarged partial view corresponding to a portion of FIG. 6;

FIG. 8 is a partial showing corresponding to part of FIG. 6 to better illustrate one of the features of the invention;

FIG. 9 is a perspective view which illustrates another feature of the invention;

DETAILED DESCRIPTION OF THE PREFERRED EMBODIMENTS

Figure 6:
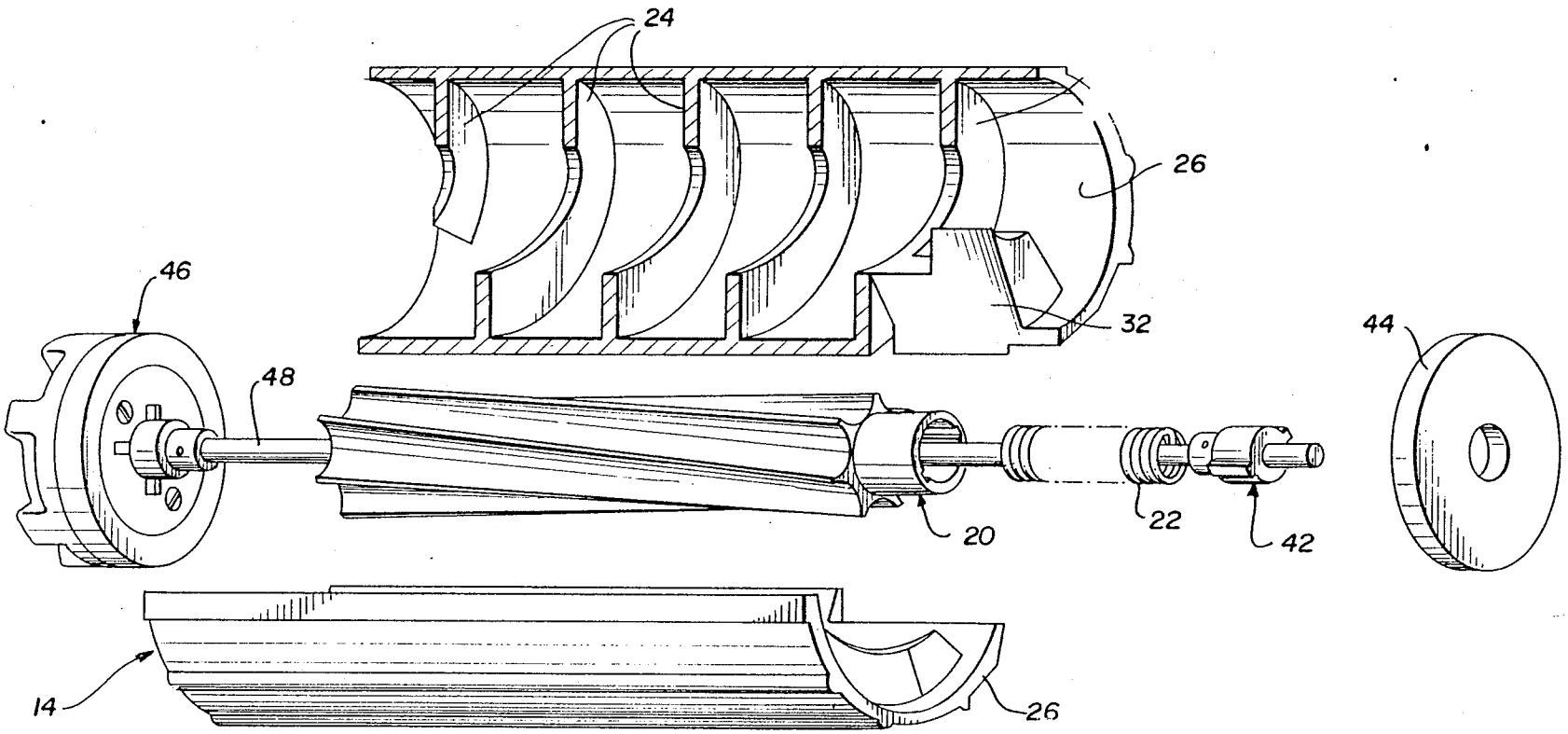
FIG. 6 is an exploded view of the magazine of the invention, with some parts broken away and in cross section, and the direction of the view being from the right side of the showing of FIG. 1.
Figure 10:
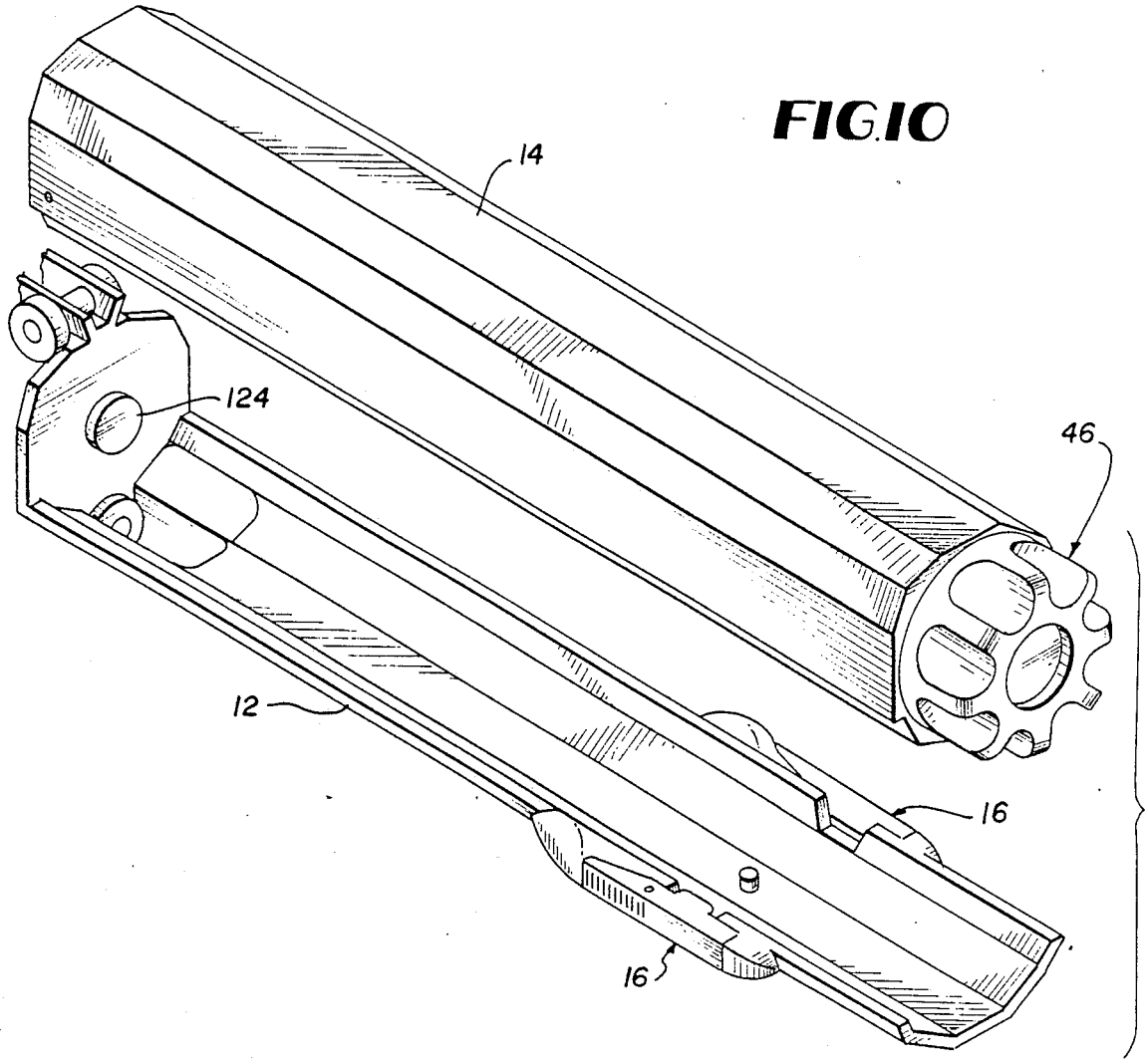
FIG. 10 is an exploded perspective view showing the mounting of the magazine onto the gun.

Referring now in detail to FIG. 1, reference numeral 10 indicates a gun and magazine system embodying the invention, and comprising a gun 12 and a magazine 14. Latch means 16 holds the magazine 14 removeably mounted on the gun 12. As mentioned above, this invention improves upon prior patents of the present inventors, and reference should be had to those documents for a more detailed explanation of those parts of the environment of the invention, such as, for example, latch means 16, as needed. This disclosure will confine itself primarily to the details of the improved magazine.

As is shown especially well in FIGS. 2, 3 and 4, an important feature of the invention is that the cartridges 18 are loaded into the magazine in a double helical row. The invention magazine includes a fluted cartridge carrier 20, which is driven by a helical torsion or torque spring 22. The parts 20 and 22 are shown best in FIGS. 6 and 8. The inner row of the cartridges 18 lie in the grooves in the cartridge carrier 20. The outer row of the cartridges 18 are in turn radially driven by the inner row. As the cartridges in both rows thus rotate, they are urged forward by a helical rib 24 which is integral to the two halves 26 making up the body of the magazine 14. Upper and lower clips 28 are provided to removeably hold the magazine body halves 26 together. These clips and their various features are shown and described in greater detail in our prior patents described above, and are omitted from various of the other figures herein.

FIG. 2 also shows an optional feature of the invention, a small rib 30 that runs between the flights of the main rib 24 which is useful with particular sizes of cartridges 18. When the cartridges 18 have a taper, the rib 30 keeps such cartridges in good contact with the driven carrier 20.

As is clear from FIG. 3, and also from FIGS. 4 and 5, the radial length of the rib 24 has to be approximately equal to and perhaps slightly larger than the diameter of a cartridge 18. Since the principle of drive is that the cartridges in the flutes of the drive member are directly driven, and the cartridges in the outer helical row nest each one between two cartridges in the inner helical row, then the rib 24 must "reach down" to the inner row of cartridges in order to assure proper feeding of all of the cartridges in both rows through the magazine. Thus, the drive force is through the carrier to each cartridge in the inner helical row, and each cartridge in the outer helical row is driven by contact with rib 24 and with the cartridges in the inner row against which it is in contact tangentially.

Fixed feed ramp 32, see FIG. 4, assures an orderly dispensing of the cartridges in a single row between the feed lips 34 and 36 and past the feed bar 38.

Referring now to FIGS. 4–7, the fixed cartridge feed ramp 32 which is molded integral with one of the body halves 26 is shown. The body half 26 which is formed with the feed ramp 32 is also formed with a feed lip 34. The companion body half 26 which does not have the feed ramp 32 is formed with a mating companion feed lip 36. The two feed lips 34 and 36 and the manner in which they cooperate to feed the cartridges 18 one by one out of the magazine 14 and into the gun 12 is shown best in FIGS. 4 and 5.

Means are provided to hold the cartridges 18 inside the feed lips 34 and 36, to permit them to exit one by one, and to permit rapid loading of the cartridges 18 into the magazine through the feed lips 34 and 36. Two this end, there is provided a feed lip bar 38 which is urged by a feed lip bar spring 40 to a downward position as shown in FIG. 5 normally blocking the exit of the cartridges 18 out of the magazine. However, when cartridges are forced into the magazine, the bar 38 easily retracts into its chamber formed in the fixed feed ramp 32 to permit such entry. The gun 12 is formed with suitable means to extract the cartridges one by one in a manner well known to those skilled in these arts.

More specifically, the spring loaded bar assembly 38, 40 holds the cartridges within the magazine against the urging of the spring driven cartridge carrier 20 in normal usage. The bar 38 permits cartridges to be successively removed from the magazine, but only longitudinally. However, when retracted, by being pushed into its cavity formed in the feed ramp 32, the bar 38 does not block the cartridge path and allows cartridges to either exit or enter the magazine radially of the magazine in uninterrupted succession. This permits rapid unloading or reloading of the magazine, which is a substantial advantage over the prior art including our own prior patented systems identified above.

FIG. 6 shows an exploded view the major components of the magazine of the invention. In addition to those described above, a splined driver 42 interconnects the spring 22 with the cartridge carrier 20 to drive the cartridge carrier and to in turn drive the cartridges through the magazine and out into the gun 12. This splined driver 42 moves longitudinally with respect to the inside of the carrier 20, in a manner described and shown in more detail in our prior patents described above. In this manner, the spring 22 is allowed to increase and decrease in length as necessary during its normal use. The magazine assembly 14 further includes a front end cap 44 which has an inwardly protruding cylindrical boss portion (not shown) that fits inside the front end of the fitted together halves 26. The magazine 14 further includes a rear end cap assembly 46 which also includes the clutch and winder for the spring 22.

Figure 11:
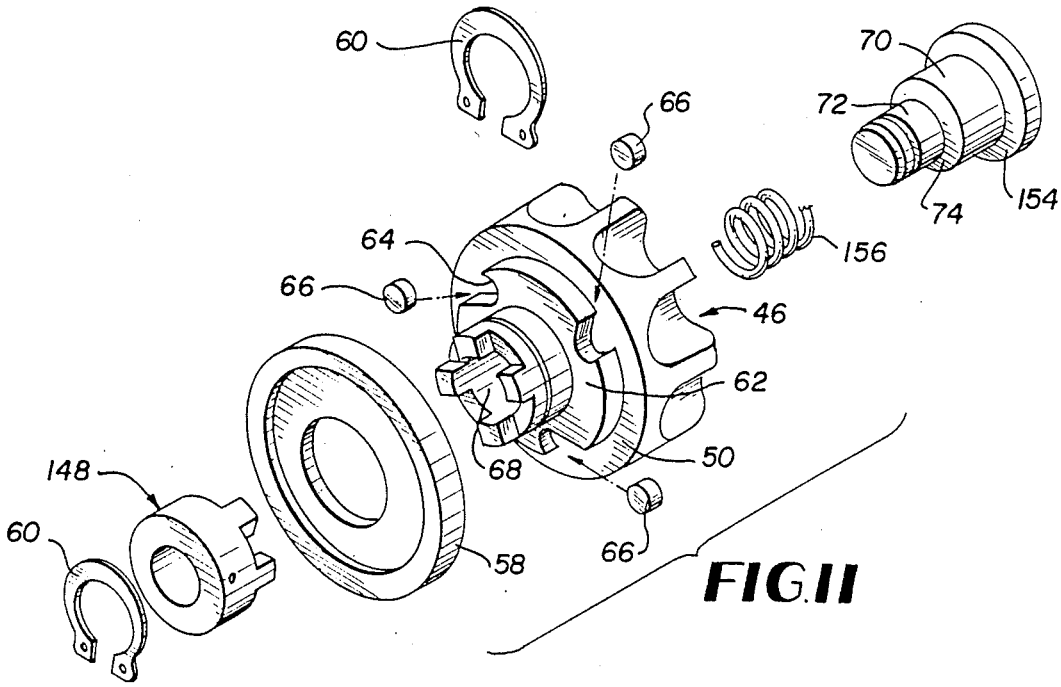
FIG. 11 is an exploded view of the magazine clutch assembly.

Referring to FIG. 11, the clutch/winder 46 is shown in detail. Overall, this part of the magazine can be thought of as a silent operating, centrifugal action, ramp-type clutch. This part of the magazine comprises a winding knob 50, a release button 154, a release button return spring 156, a clutch race member 58, and the front dog member 148. Front and rear snap rings 60 are used to hold the parts of the clutch assembly 46 together.

The clutch knob assembly 50 is formed with a circular shoulder portion 62 which is formed with three equally radially spaced clutch member grooves or ramps 64. Each groove receives a clutch member 66 which in the embodiment shown is in the form of a small cylinder. The shoulder portion 62 fits snugly within a recess on the inside (not shown) of the race member 58.

These parts, 58, 62, 64 and 66, are so configured that when the knob 50 is turned in the winding direction, the ramps or slope built into the groove 64 is such as to cause the member 66 to roll down into the groove 64, radially inwardly. This permits a free motion of the shoulder 62 on the inside of the race 58. However, as soon as that winding force is released, the energy stored in the torsion spring 22 will impart a vigorous counter rotation force to the knob member 50, which will, by centrifugal force, throw the clutch members 66 radially outwardly, where they will wedge between the ramps 64 and the inside of the race member 58.

Concentrically with the shoulder portion 62, the knob member 50 is formed with a rear end dog portion 68.

The release button 154 is formed with an enlarged rear portion 70, and a front reduced diameter portion 72, these two portions being separated by an annular shoulder 74. Here again, reference may be had to our prior patents for more details of these parts.

Referring now to FIGS. 6 and 8, the invention includes a rod 48 which is fixed as by being secured to a bushing, to the rear end clutch-winder assembly 46. The front end of rod 48 extends through a suitably formed opening (FIG. 6) in the front end cap 44 of the magazine, and bears against the firearm in use. The rod also passes through the splined driver 42.

This rod 48 is one of the new features of the invention. The rod prevents overwinding of the spring 22 by solidly stopping the proportional decrease of the spring diameter as it becomes fully wound. The diameters of the spring 22 and of the rod 48 are selected so that the spring will close down on the rod thus positively preventing further winding of the spring beyond a maximum fully wound condition of the spring 22. Since the rod 48 is also solidly attached to the magazine clutch assembly 46, it prevents the clutch from opening and releasing the energy stored in the spring so long as the front end of the rod impinges against a solid object. Thus, because, as shown and described in our prior patents, the clutch 46 is disengaged by longitudinal motion along the direction of the rod 48, it is not possible to accidentally release the energy stored in spring 22 while the magazine is mounted on the gun. The user must remove the magazine from the gun to release the clutch. Rod 48 is shown as a solid metal rod, but it can also be a tubular rod-like member made of metal or other material.

As shown in FIG. 8, the winder and clutch assembly 46 includes a winding knob 50. This part is shown in more detail in our prior patents. FIG. 9 shows a variation of this knob 52 which includes a winder handle 54 mounted on the knob 52 on a pivot pin 56. While the parts are shown somewhat exaggerated and out of proportion in size in FIG. 9 for the sake of clarity, it will be understood that the handle 54 folds down and out of the way when not in use. That is, when the handle is folded down, opposite the position shown in FIG. 9, it is out of the way and does not interfere with the smooth profile of the end cap winder assembly 46. The central opening through the cap 52 in FIG. 9 is provided for the clutch release push button, again reference should be had to our prior patents for details.

While the invention in its preferred embodiments locates the magazine in line with and above the center line of the barrel of the firearm, it is readily apparent that other embodiments, other attaching means and other configurations can be accomplished while still utilizing the improved magazine of the invention.

It is well known by those skilled in these arts, that weight and bulk are two of the main problems in the design of firearms. That is, it is desired that weight and bulk be reduced as much as possible. The double row helical magazine of the present invention makes possible a firearm having a heretofore unheard of large ammunition capacity, and does so with overall dimensions and weight which are minimum. The preferred embodiment of the invention described above is constructed almost entirely of plastic materials, which provides the most practical means to manufacture the geometrically complex parts required. Further, the use of plastics produces a magazine which is significantly lighter per cartridge than conventional magazines. Further, the present invention is a substantial improvement over the magazine of the prior patents identified above, in that it is more compact, has a lighter weight per cartridge, is easier to operate, and thus is safer. Finally, it should be noted that the present invention is not limited to a particular quantity or size of ammunition cartridge, but can be adapted to many different requirements as to both cartridge size and total capacity.

While the invention has been described in detail above, it is to be understood that this detailed description is by way of example only, and the protection granted is to be limited only within the spirit of the invention and the scope of the following claims.

We claim:

1. An ammunition magazine for a gun, said magazine being of an elongated, generally cylindrical configuration, said magazine comprising an outer housing, a drive member for ammunition cartridges rotatably mounted within said outer housing, a drive spring strong enough to rotate said drive member within said housing even when said magazine is filled with cartridges, said drive spring comprising a helical torsion spring having a length less than the length of said magazine, means to prevent overwinding and kinking of said drive spring, said preventing means comprising rod means extending through the center of said torsion spring, and said rod means having a length substantially equal to the length of said magazine, manual winder means for said spring, means to fix one end of said rod to said spring, said magazine including manual clutch means to permit release of the energy stored in said spring, and said rod means and said magazine including means to permit operation of said manual clutch means only when said magazine is not mounted on a cooperating gun.

2. The magazine of claim 1, and the diameters of said helical torsion spring and of said rod being selected so that said spring will close down on said rod means to prevent further winding beyond a predetermined fully wound condition of said spring defined by the closed down condition of said spring on said rod means.

3. The magazine of claim 1, said rod means comprising a solid metal rod.

* * * * *